US005617706A

United States Patent [19]

Hartman et al.

[11] Patent Number: 5,617,706

[45] Date of Patent: Apr. 8, 1997

[54] ACCUMULATOR AND COLLATOR FOR PACKAGING APPARATUS

[75] Inventors: Donn A. Hartman, Gurnee; William N. Pearson, Highland Park, both of Ill.

[73] Assignee: Cloud Corporation, Des Plaines, Ill.

[21] Appl. No.: 507,931

[22] Filed: Jul. 27, 1995

Related U.S. Application Data

[63] Continuation of Ser. No. 294,657, Aug. 23, 1994, abandoned, which is a continuation of Ser. No. 940,521, Sep. 4, 1992, Pat. No. 5,359,832.

[51] Int. Cl.[6] ..... B65B 9/08; B65B 61/10

[52] U.S. Cl. ..... 53/435; 53/64; 53/520; 53/562; 83/236

[58] Field of Search ..... 53/435, 455, 513, 53/520, 568, 567, 562, 64, 77, 52; 83/236, 336

[56] References Cited

U.S. PATENT DOCUMENTS

| | | | |
|---|---|---|---|
| 3,548,695 | 12/1970 | Pearson | 83/236 |
| 3,597,898 | 8/1971 | Cloud . | |
| 3,680,418 | 8/1972 | Phillips | 83/236 |
| 3,683,729 | 8/1972 | Cloud . | |
| 3,757,620 | 9/1973 | Cloud | 83/345 |
| 4,430,914 | 2/1984 | Keim | 83/236 |
| 4,525,977 | 7/1985 | Matt | 53/55 |
| 4,545,780 | 10/1985 | Martin | 83/236 |
| 4,570,418 | 2/1986 | Gino | 53/520 |
| 4,574,566 | 3/1986 | Eaves et al. | 53/450 |
| 4,712,357 | 12/1987 | Crawford et al. | 53/550 X |
| 4,807,420 | 2/1989 | Barker | 53/51 |
| 5,060,450 | 10/1991 | Greenwell et al. | 53/113 |
| 5,094,657 | 3/1992 | Dworak et al. | 493/208 |
| 5,117,608 | 6/1992 | Nease et al. | 53/51 |
| 5,133,172 | 7/1992 | Soubrier | 53/562 |
| 5,138,815 | 8/1992 | Groschen, Jr. | 53/55 |

FOREIGN PATENT DOCUMENTS

| | | |
|---|---|---|
| 0059844 | 9/1982 | European Pat. Off. . |
| 0083912 | 7/1983 | European Pat. Off. . |
| 2204551 | 11/1988 | United Kingdom . |

OTHER PUBLICATIONS

Letter dated Jun. 7, 1991, from Donn A. Hartman to Dennis Calmusa, regarding sale of device.

Proposal dated Jun. 26, 1991 from Klockner–Bartelt, Inc. to August Oetker, regarding proposed bid for sale of device.

*Primary Examiner*—James F. Coan

*Attorney, Agent, or Firm*—Dorn, McEachran, Jambor & Keating

[57] ABSTRACT

A packaging machine including packaging apparatus to form fill and seal a chain of connected packages, a cutting station to separate the packages, means to operate the forming, filling and sealing apparatus and cutting apparatus so as to cut more packages than are formed, filled and sealed during a given time period.

29 Claims, 10 Drawing Sheets

FIGURE 14
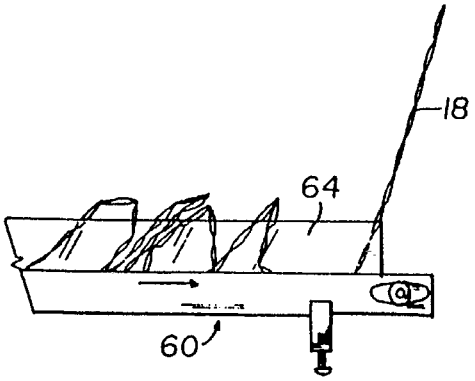
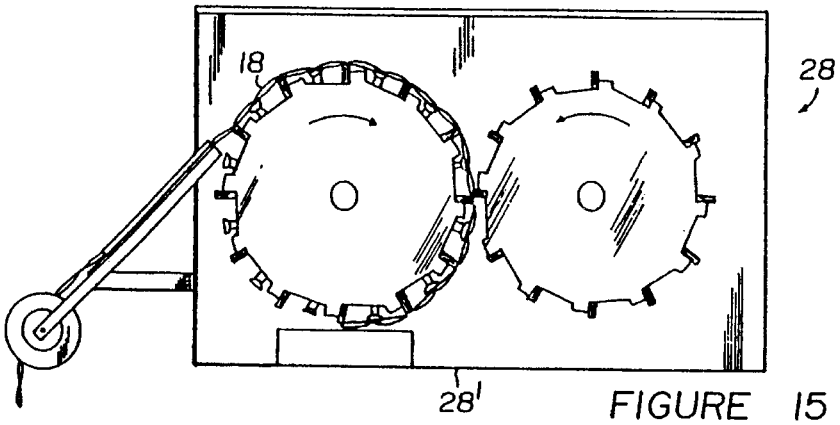
FIGURE 15
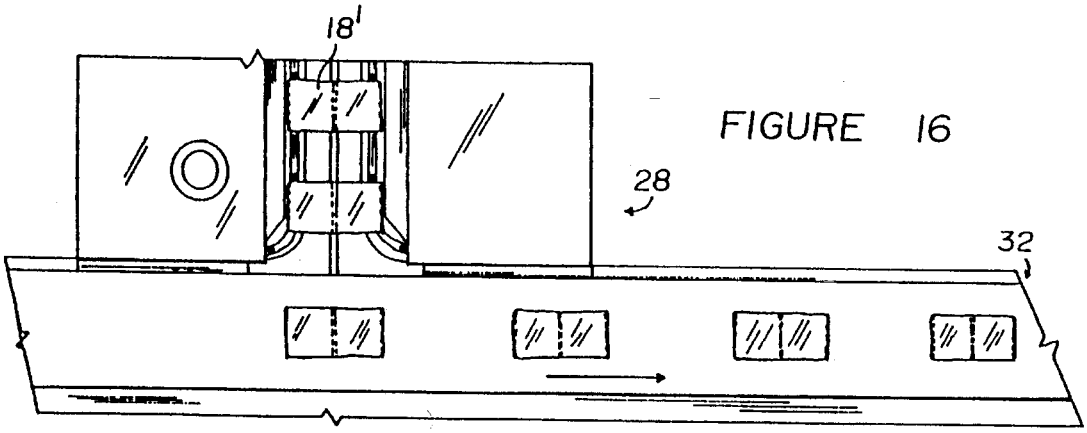
FIGURE 16
FIGURE 17
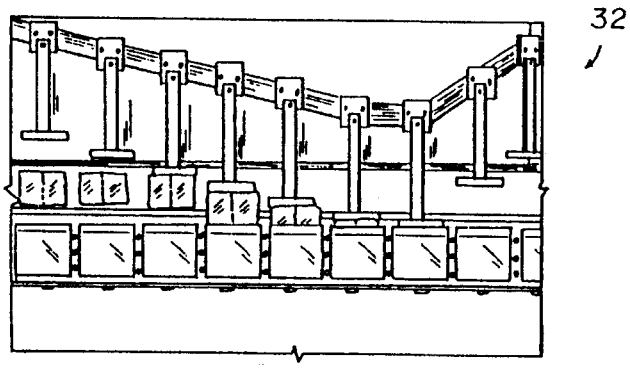

ACCUMULATOR AND COLLATOR FOR PACKAGING APPARATUS

This is a continuation of U.S. patent application Ser. No. 08/294,657, filed on Aug. 23, 1994, now abandoned which is a continuation of U.S. patent application Ser. No. 07/940,521, filed on Sep. 4, 1992, now U.S. Pat. No. 5,359,832.

BACKGROUND OF THE INVENTION

1. Field of the Invention

The present invention relates to a method and apparatus for accumulating a series of filled packages formed by a high speed packaging machine. More specifically, the accumulating apparatus is provided to allow for continued creation of filled packages and accumulation of same during periods of downtime for a downstream knife machine and cartoner of the packaging apparatus.

2. Description of the Prior Art

Machines for high speed production of a strip of filled packages are known, exemplary devices being disclosed in the Cloud U.S. Pat. No. 3,597,898 and the Cloud U.S. Pat. No. 5,094,657.

Further, method and apparatus for cutting the strip of packages apart are also known from the Cloud U.S. Pat. No. 3,683,729 and the Cloud U.S. Pat. No. 3,757,620.

Heretofore, the cutting apparatus has been mounted immediately adjacent an outlet from the packaging machine, with a cartoning machine being provided downstream of the cutting apparatus.

Thus, if the cartoner fails, cut apart packages overflow until the packaging and cutting machines are shut down. Not only does overflow develop, but the quantity of packages produced over a specific time period is drastically reduced. Further, the creation of scrap is significantly increased. If, however, means were provided within the apparatus which could accumulate the uncut stripe of packaged product during periods of non-function of the cartoner, the quantity of filled packages produced per given time period could be increased significantly. Further, since cartoning can take less time than packaging, the cartoner, once functional again, could catch up cartoning the accumulated product, with downtime of up to 10 minutes being easily accommodated with the packaging machine running at full speed.

Still further, if the packaging machine were run at half speed, 20 minutes of package production could be accommodated before requiring shutdown, with the cartoner being run more quickly once up again to take up the overage or excess.

Inasmuch as it would be preferable for accumulation to take place before cutting apart the series of filled packages, the apparatus and method of the present invention propose relocating the knife or cutting assembly near or onto the cartoner, and interposing speed control and accumulation structure between the packaging machine and the knife or cutting apparatus thereof.

SUMMARY OF THE INVENTION

According to the invention there is provided in a circuitry controlled packaging apparatus of the type including a packaging station, a cutting station for separating packages produced in chain fashion in the packaging station, and a cartoner for cartoning the separated packages, the improvement comprising: an accumulator structure functionally engaged between an outlet from the packaging station and an inlet to said cutting station for accumulating thereon, any overflow of chained packages created in the packaging station, within predefined limits, until such overflow is accommodated by said cartoner, such as during times of cartoner shutdown.

Further according to the invention there is provided a method of accumulating packages upstream of a cartoner of a packaging machine upon stoppage of said cartoner, said method comprising the steps of:

creating chained packages of product;

feeding said packages into and through a control apparatus which is operable at a rate corresponding to a chosen rate of package creation;

said control apparatus supplying said chained packages onto an accumulator structure;

said packages feeding from said accumulator to a cutting station which severs the chained packages apart;

said severed packages being supplied to a cartoning station for packing; and when said cartoning station fails to operate, shutting down operation of said cutting station and accumulating uncut chained packages upon said accumulator for a predetermined time period.

BRIEF DESCRIPTION OF THE DRAWINGS

FIG. 14 shows a strip of packages at an exit end of the accumulator structure.

FIG. 15 shows the strip of packages entering and being cut into separate packages within a cutting or knife station of the apparatus.

FIG. 16 shows the cut apart packages being transported by a pin conveyor onto a belt conveyor which feeds the packages, singly or in stacks, onto a belt conveyor feeding a cartoner station of apparatus.

FIG. 17 shows the packages being cartoned within the cartoner station of the apparatus.

DESCRIPTION OF THE PREFERRED EMBODIMENT

Figure 1:
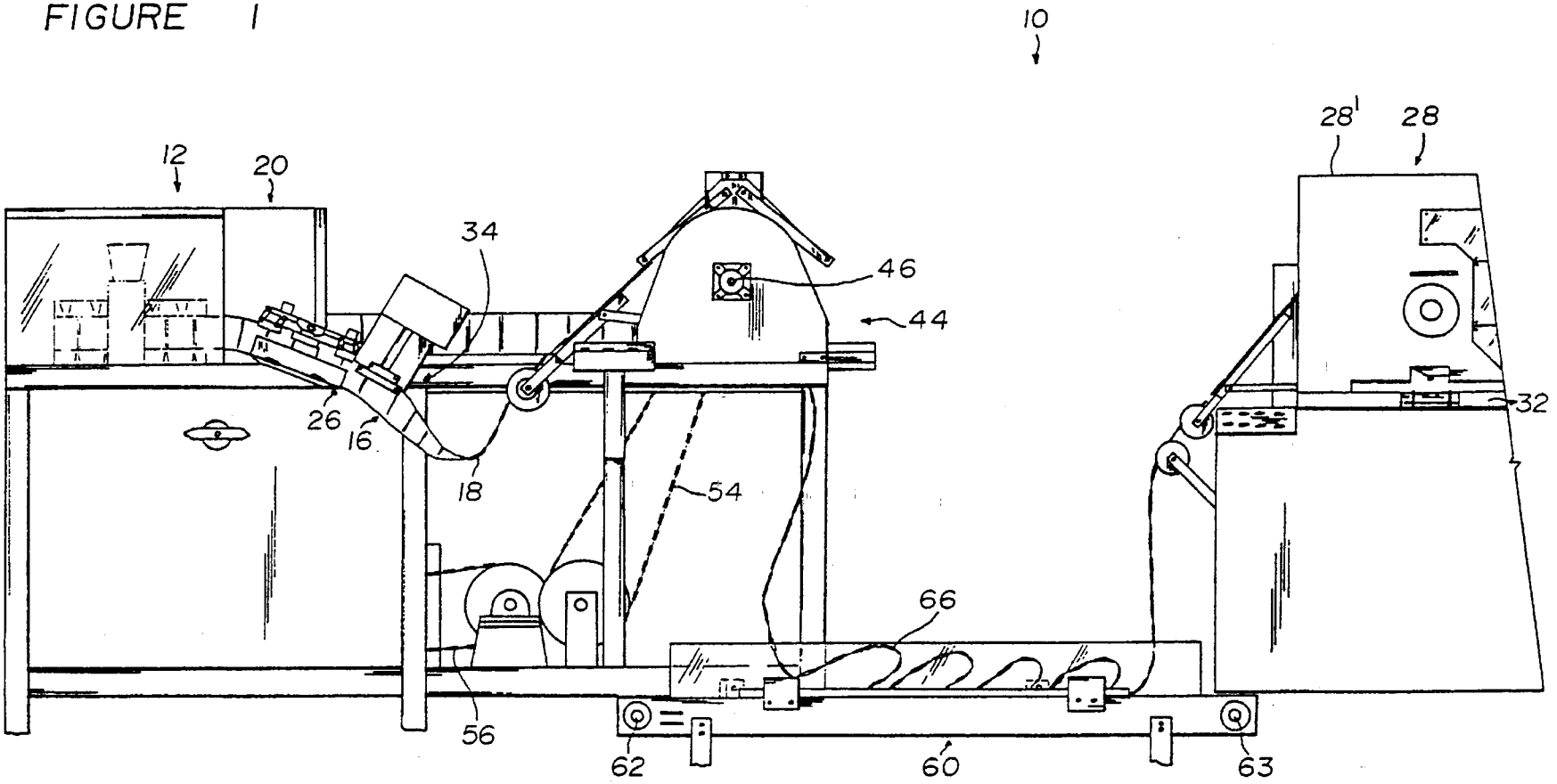
FIG. 1 is a side view of a packaging apparatus made in accordance with the teachings of the present invention.
Figure 2:
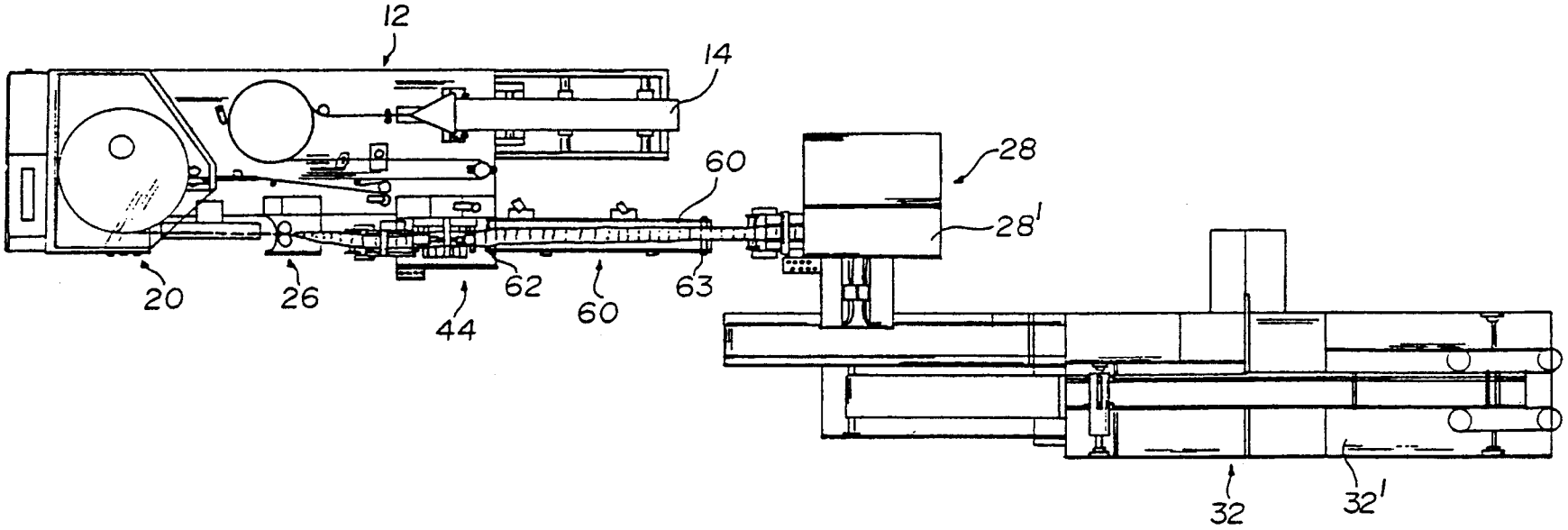
FIG. 2 is a top plan view of the apparatus of FIG. 1.
Figure 3:
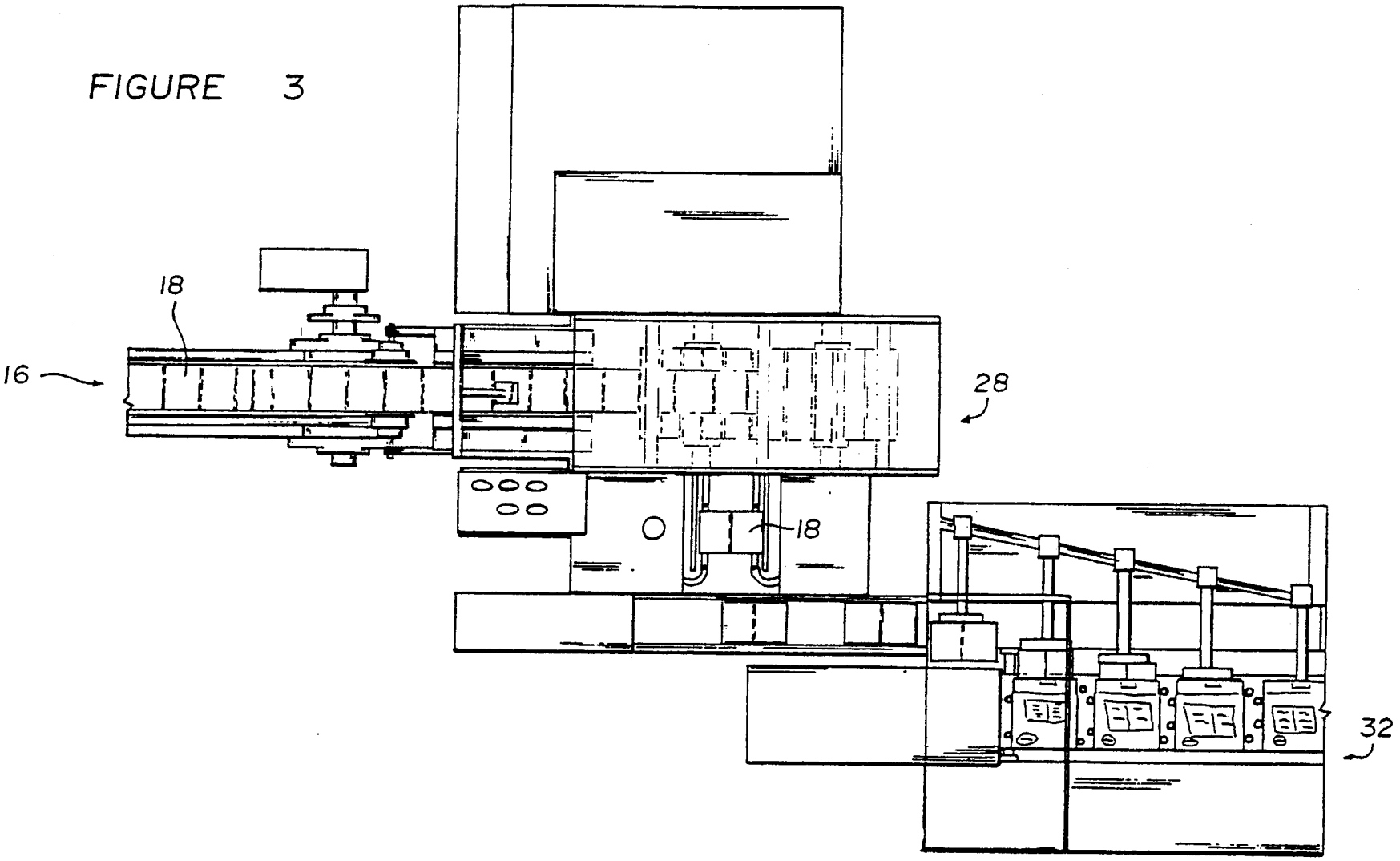
FIG. 3 is an enlarged top plan view of the knife assembly shown adjacent and mounted to the cartoning machine of apparatus.
Figure 6:
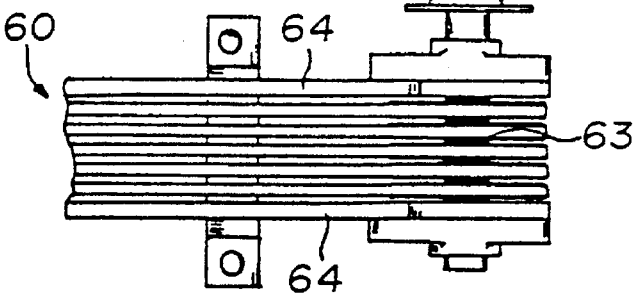
FIG. 6 is a top view of another end of the conveyor of FIG. 4, and shows a banded conveyor belt mounted over an end core thereof.
Figure 7:
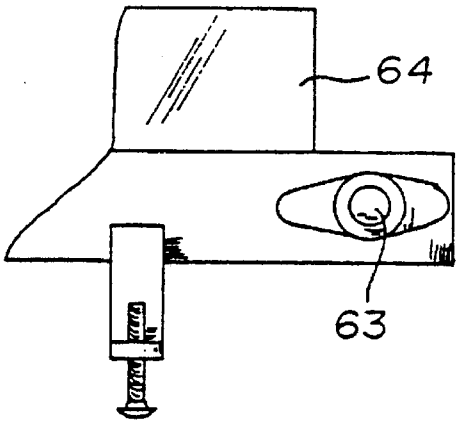
FIG. 7 is a side view of the conveyor end of FIG. 6 showing a continuation of the alignment shoulder of FIG. 5.
Figure 4:
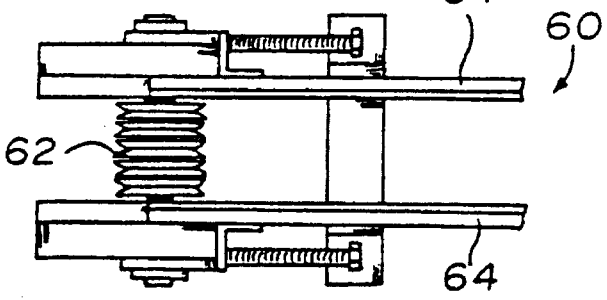
FIG. 4 is a top view of one end core of a conveyor forming a first embodiment of an accumulator structure.
Figure 5:
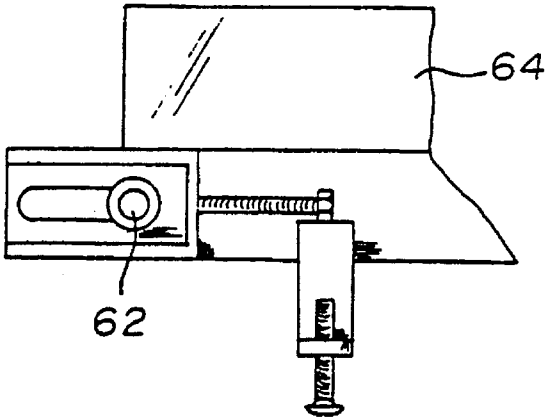
FIG. 5 is a side view of the structure of FIG. 4 showing an alignment shoulder thereof.

Referring now to the drawings in greater detail, there is illustrated therein the packaging apparatus of the present invention generally identified by the reference numeral 10.

As shown, the apparatus 10 incorporates several station. therein. First provided is a package farming station 12, wherein at least one roll of material 14 is processed into a chained strip 16 of three or four sided packages 18. Next, a filling station 20 is provided which fills the partially formed packages 18 with a particular product 22. Once product 22 has been appropriately dispensed into the packages 10, an open edge 24 of the packages 18, through which the product 22 was received, must be closed. This closure of the open package end 24 takes place at a sealing station 26 in known manner.

Typically, once such sealing takes place, the strip 16 of chained, now closed packages 18 immediately would enter a cutting station 28 incorporating a knife machine 28' therein for cutting individual packages 18' from the chained strip 16. These packages 18', or a chosen plurality of same would then be immediately fed to a cartoning station 32, for packing.

As stated hereinbefore, if the cartoning station 32 fails in operation for one reason or another, the cutting station 28 and all upstream stations would have to be shut down, the packages 18' being unable to collect anywhere until the cartoning station 32 was once again functional.

This required shutting down of the entire packaging apparatus 10, as will be easily recognized, cut significantly into profitability, as well as significantly decreasing the number of product filled packages 18, 18' which a packaging apparatus 10 whose cartoning station 32 failed would produce over a given time period.

Thus, the present apparatus 10 was designed to accommodate continued function of all stations upstream of the cutting station 28 for a significant period of time, during downtime periods for a cartoning station 32 of the apparatus 10, and incorporating elements therein which would allow the cutting and cartoning stations, 28 and 32, respectively, upon return to a functional status, to function at a significantly increased pace and with a possibly slowed pace of package production, until the accumulated packages 18 formed during downtime were accommodated, with all stations once again becoming synchronized after such accumulation is accommodated.

The first modification required to allow for means for accumulating packages to be provided was to remove the cutting station 28 from its usual mounting at an outlet end 34 from the sealing station 26. If the cutting station 28 were instead incorporated onto a cartoner 32' at the cartoning station 32, then a hiatus created between the sealing station 26 and the cutting station 28 could accommodate structure therein which could accumulate packages 18 thereon for a preselected time period, with package production 18 being slowed, rather than stopped during periods of cartoning station 32 downtime and with control being provided which would increase cartoning speed upon return to functionality of the cartoner 32' until such accumulation were accommodated.

Inherently, if the cutting station 28 is proposed for mounting onto the cartoner 32' at the cartoning station 32, the knife machine 28' of the cutting station 28 must operate at a rate which corresponds to the rate at which the cartoner 32' functions and therefore, control of knife machine 28' and cartoner 32 function must remain correlated at all times by control circuitry 40 (FIG. 22) provided for the apparatus 10.

With respect to providing means for accumulating packages during downtime periods of the cartoner 32', it will first of all be understood that means for directing output of formed packages 18 must be provided inasmuch as such directing function was heretofore provided by a cutting station 28 mounted thereto.

Figure 12:
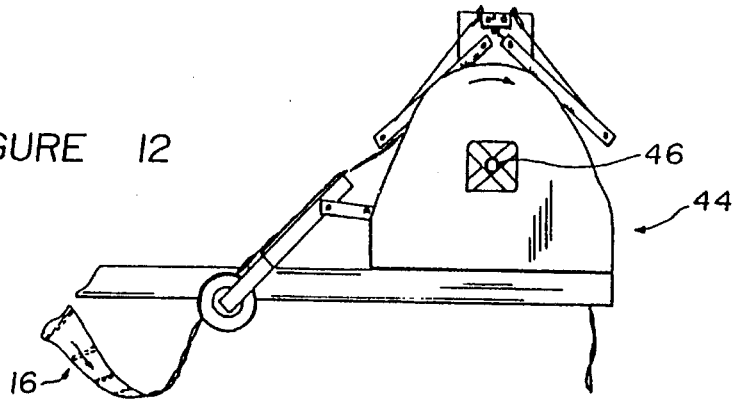
FIG. 12 shows the strip of filled packages being fed into and through a control and alignment system commonly referred to as a squirrel cage.
Figure 13:
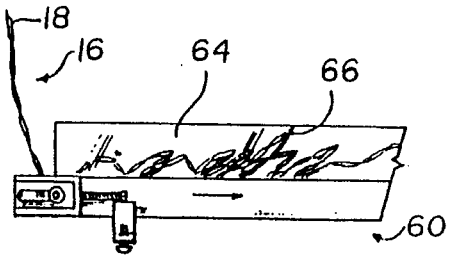
FIG. 13 shows a strip of packages exiting the squirrel cage and accumulating on the accumulator structure of FIG. 1.
Figure 18:
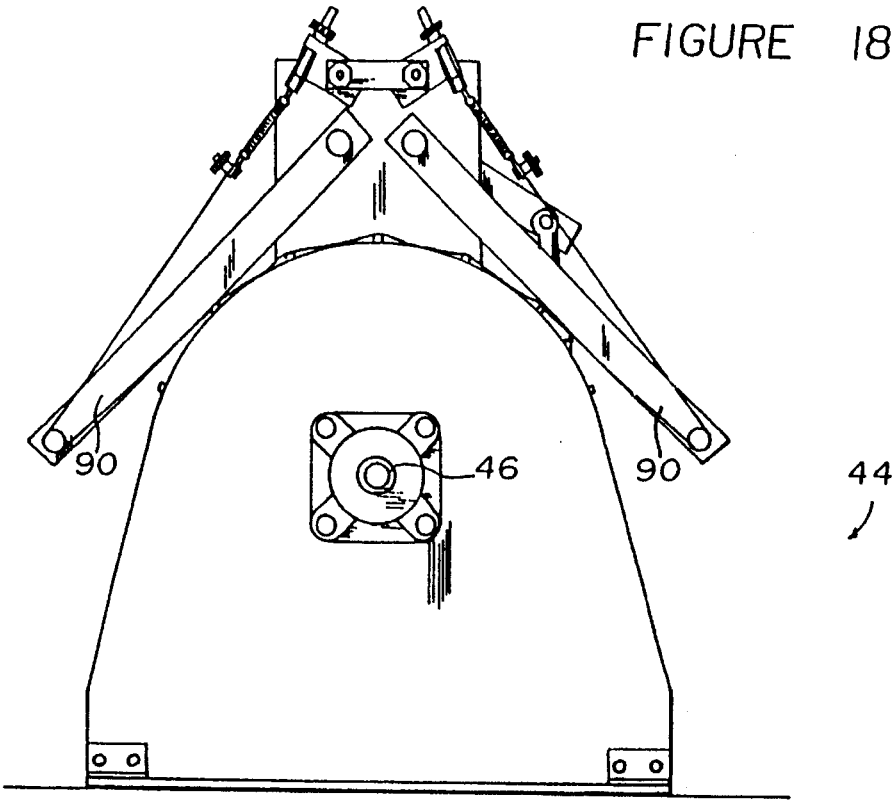
FIG. 18 is an enlarged side view of the squirrel cage of the system.

Referring to FIGS. 1 and 12, it will be seen that direction, alignment, flow and rate are all necessarily parameters which are be controlled by structure provided in lieu of the cutting station 28 preferably with the structure proposed being operated in a manner identical to that in which the cutting station 28 was operated so that no significant, costly or time consuming modifications need to be made to the packaging apparatus 10 to accommodate such proposed replacement output control structure.

To accomplish this end, a structure 44 commonly referred to herein as a squirrel cage 44 Is provided. The squirrel cage 44 is operated under circuitry 40 control and engages upon a chain driven shaft 46 which previously engaged and operated the knife machine 28'.

As best shown in FIGS. 18–21, the squirrel cage 44 has an internal paddle wheel 48, paddles 50 of the wheel 48 being spaced therearound in a manner to accommodate adjacent chained packages 18. To assure alignment of the chained packages 18, each paddle 50 is provided with a centered radial edge channel 52, with the packages 18 being accommodated within the channels 52. Speed of rotation of the paddle wheel 48 must necessarily correspond to speed of package 18 production and such correspondence may be produced through appropriate mechanical drive correlation.

Figure 22:
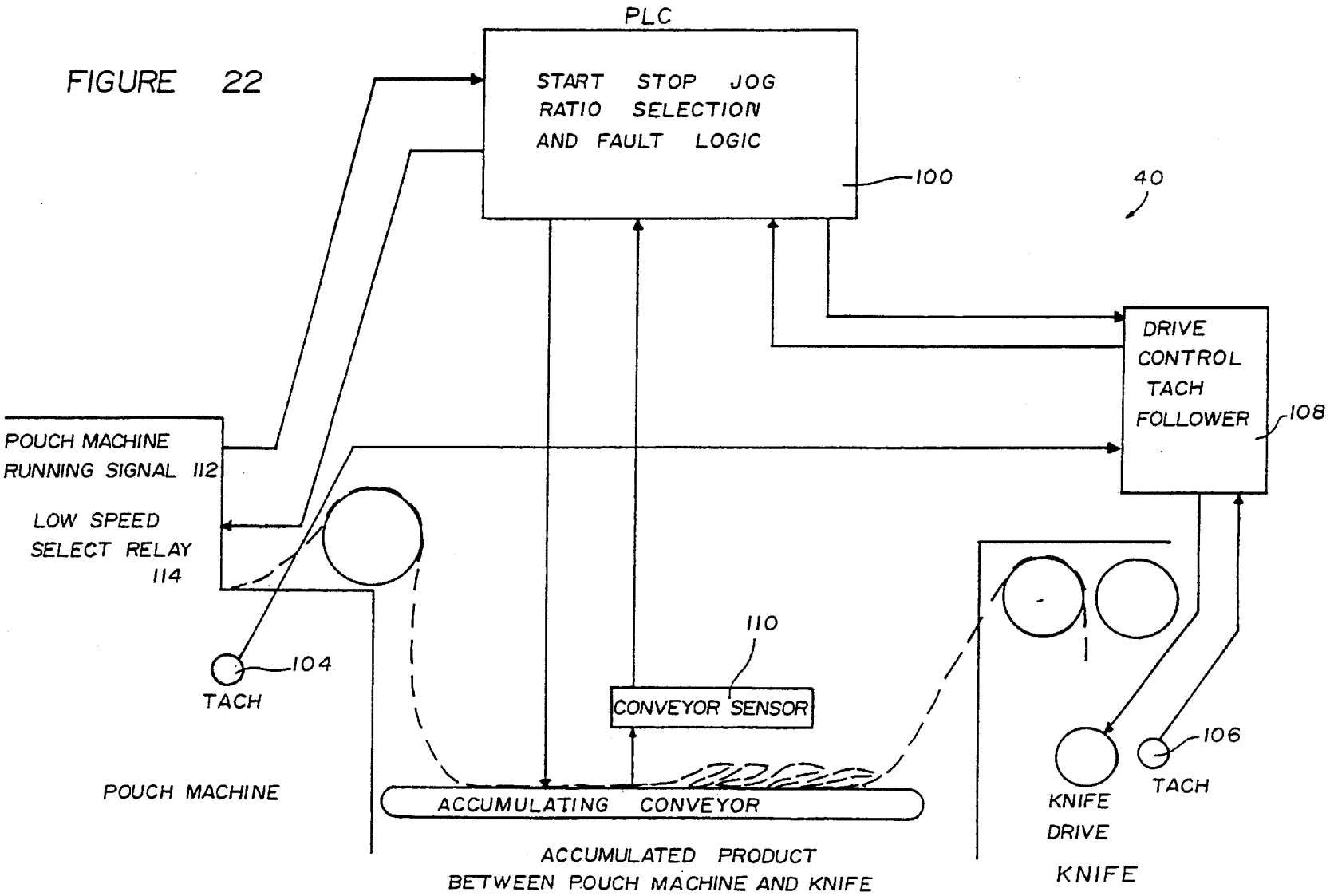
FIG. 22 is a block diagram showing how control of the various stations is accomplished through use of a programmable logic controller.

Inasmuch as such correspondence Is required, the wheel 48 is driven by a chain 54 which is operated synchronously with a drive chain 56 of the packaging station 12, as will be shown in detail in describing FIG. 22.

From this squirrel cage 44, the strip 16 of chained packages 18 is fed onto an accumulator 60 which may be of any desired, functional form. For the purposes of simplicity of disclosure, a first form of accumulator is shown to comprise a continuous conveyor belt 60 supported on terminal shafts 62 and 63. Here, the conveyor belt 60 is shown to be made of parallel bands of belt material, though this is not to be construed as limiting.

The conveyor 60 is also provided with side walls 64 used to maintain the packages 18 aligned thereon. The conveyor 60 is driven in any suitable manner, with the speed of the drive being controlled by the circuit 40.

Obviously if packaging is rapid and the conveyor 60 is rapidly moving, the strip 16 of packages will lie more or less prone thereon. However, if the speed of the conveyor 60 is slowed, as would be desired during periods of accumulation, the strip 16 of packages 18 would fold over itself in loops 66. By the formation of such loops 66, it will be understood that a substantial number of packages 18 can be accumulated on the conveyor 60.

As stated previously, the conveyor 60 has been found able to accommodate packages 18 produced during a ten minute period when the packaging station 12 is run at full speed or those produced during a twenty minute period when the packaging station 12 is operated at half speed.

This period of accumulation should allow enough time to reactivate the cartoner 32' after failure without need to cease creating packages 18, increasing productivity and decreasing waste substantially.

It will be understood that any type of accumulator 60 could be provided, so long as placement thereof is upstream of the cutting station 28.

Figure 8:
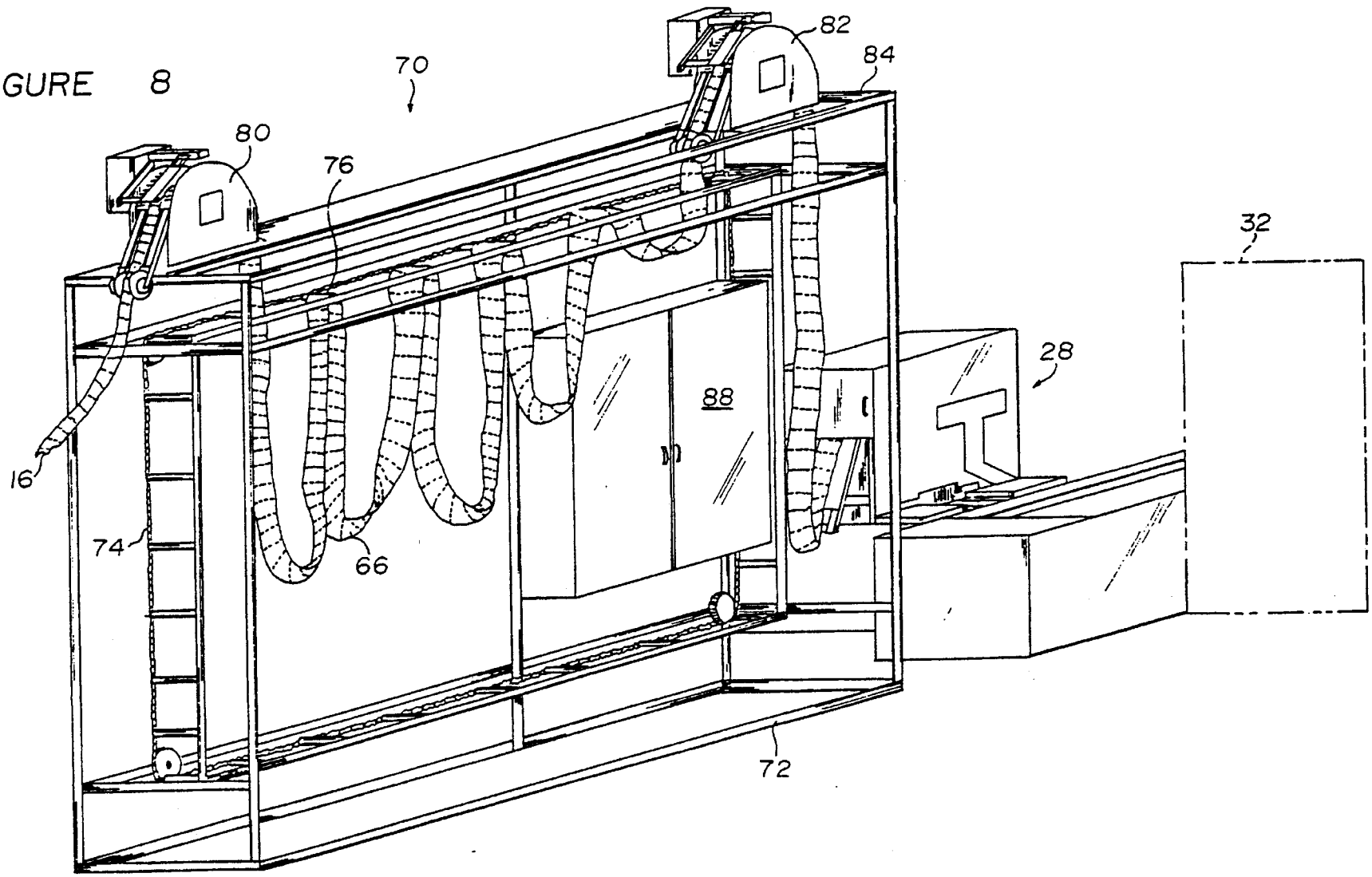
FIG. 8 is a perspective view of a secondary embodiment of an accumulator structure for the apparatus.
Figure 9:
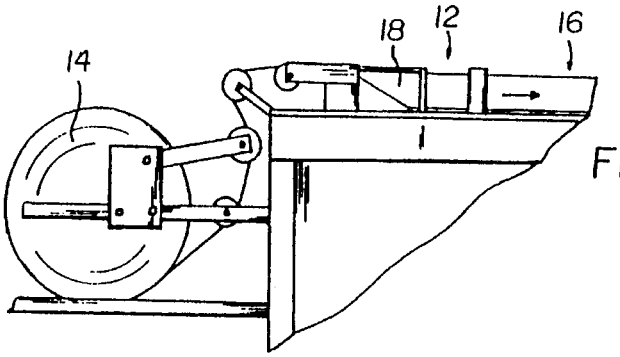
FIG. 9 is a view of the packaging station of the packaging apparatus of FIG. 1 showing a package being formed from a continuous strip of material.

To underscore adaptability of the apparatus 10, a second embodiment of an accumulator 70 is illustrated in FIG. 8.

Here the accumulator 70 is seen to incorporate a framework 72 within which a driven runged closed loop conveyor 74 is supported.

As shown, loops 66 of a strip 16 of chained packages 18 may be dropped over rungs 76 traversing the top flight of the conveyor 74.

Feeding onto the rungs 76 as well as removal therefrom of the strip 16 must be accomplished in such a manner that no stress is placed on the strip 16 to cause disruption of same.

Accordingly, two control apparatus 80 and 82 are provided, one at either end of the framework 72. These control apparatus 80 and 82 may be equivalent to the squirrel cage 44 previously described.

As shown, the strip 16 is first fed into and through control apparatus 80, which is fixed in place on the framework 72. The strip 16 exits the apparatus 80, falling between rungs 76 moving thereunder until the rungs 76 travel a distance sufficient to cause feeding of the strip 16 into the next slot preceding the adjacent following rung 76. Obviously, the speed of the flight of the conveyor 74 is controlling with respect to the length of the loops 66 formed in this manners i.e., a slower flight creates longer loops 66 and a faster flight creates shorter loops 66.

At an exit end 84 of the framework 72 the second control apparatus 82 is provided. This control apparatus 82 is movable toward and away from the first apparatus 80, with such movement being controlled by the circuitry 40. Such movement potential is required and must be monitored to prevent disruption of the strip 16, such disruption being prevented by moving the control apparatus 82 into close proximity to the apparatus 80 when essentially no accumulation exists, creating a substantially direct feed between the apparatus 80 and 82.

In this conveyor system 70, because control and operational requirements are rather complex, circuitry for operation of the system 70 is localized within a case 88 therefor.

Figure 10:
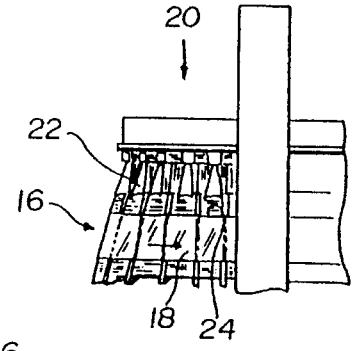
FIG. 10 shows formed packages being filled through an open top end thereof at a filling station of the apparatus.
Figure 11:
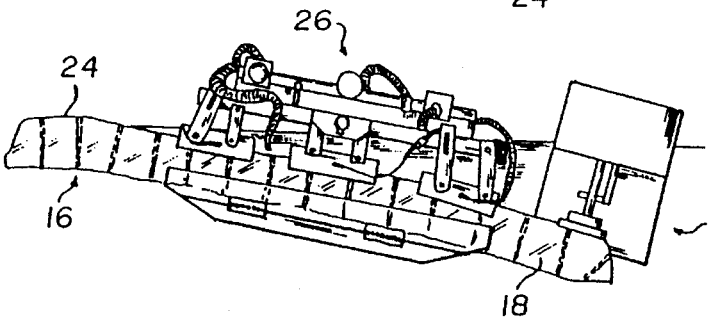
FIG. 11 shows a sealing device sealing the open end of the filled packages at a sealing station of the apparatus.
Figure 19:
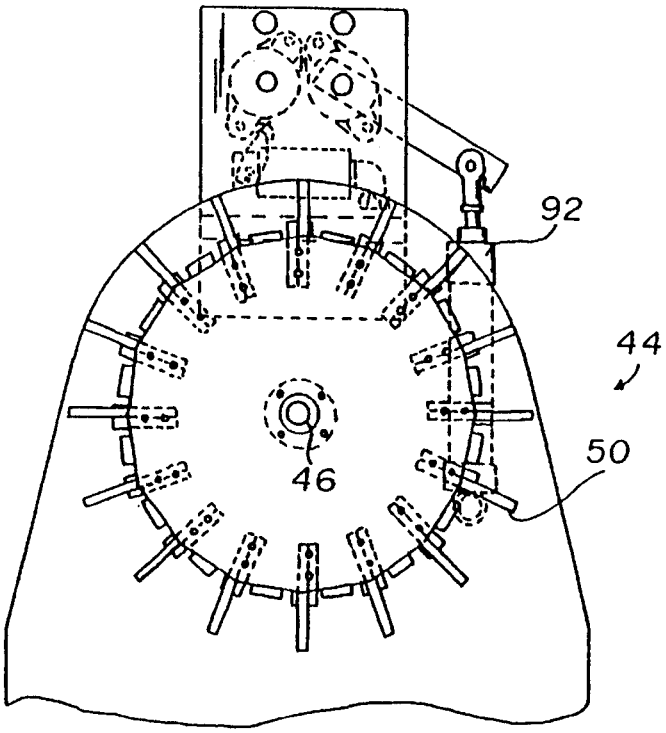
FIG. 19 is a side view of the squirrel cage with portions broken away to show an alignment and control wheel thereof.
Figure 20:
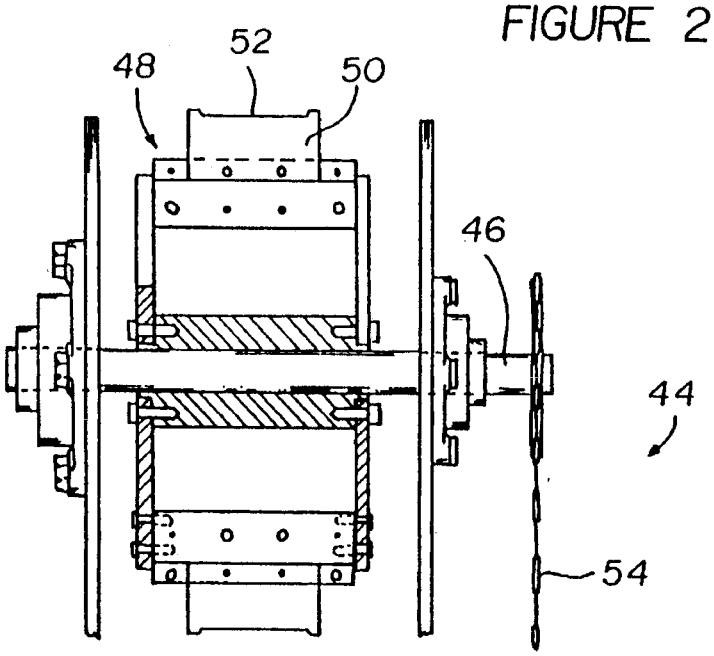
FIG. 20 is a side view of the wheel of FIG. 19 showing a central alignment groove within radially extending paddles of the wheel.
Figure 21:
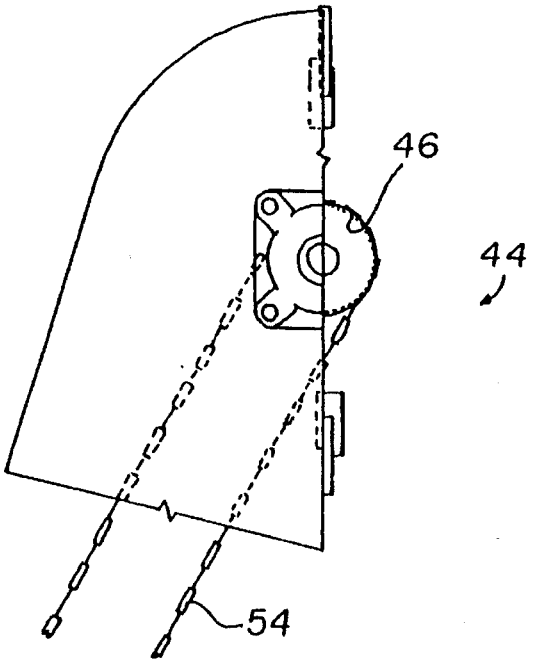
FIG. 21 shows the squirrel cage to be chain driven.

Turning briefly to FIGS. 10 and 19, it will be seen that each squirrel cage 44 includes retractable pressure arms 90 which act synchronously to place a slight pressure against wheel paddles 50 to maintain a taut engagement of the packages 18, so no slack forms in the strip 16.

Disengagement of the arms 90 is created by activation of an hydraulic mechanism 92 which acts to simultaneously raise or lower the arms 90, as desired.

It will be further understood that the squirrel cage can also act as a counter for the apparatus 10 if such function is desired.

In FIG. 22 is shown a simple block diagram showing the various interconnections between sensors of the apparatus 10, a programmable logic controller 100 thereof, and the controlled structures.

The programmable logic controller 100 may be generic, as may the sensors and activators, so long as the packaging, filling and sealing stations 12, 20 and 26, respectively are coordinated to function as a single unit and so long as the cutting and cartoning stations 28 and 32 are also operated as a single coordinated unit. Speed sensors 104 and 106 for the pouch machine 12 and cartoner 32, respectively, may be recognized as simple tachometers, with output from the pouch machine tachometer 104 being fed to a cartoner controller 108, to allow for correspondence of function between the two ends of the apparatus 10.

In the circuitry 40, there is also required input from and output to the chosen accumulator, 60 or 70, in the disclosed embodiments. Input is provided by means of any suitable sensor 110, and output from the programmable logic controller 100 is directed to the chosen drive mechanism for same.

Although only the knife drive 120 is shown here to be in operative engagement with the tachometer 106, it will be understood that a cartoner drive (not shown) is also coordinated into the circuit, perhaps through secondary use of the tachometer 106, to cause shutdown of the cutting station 28 upon stoppage of the cartoning station 32.

To complete the circuit, a pouch machine running signal 112 is fed to the programmable control logic 100 and output from the logic 100 is directed to a speed select relay 114 for controlling package production speed during cartoner 32' downtime.

The programmable logic controller 100 is as simply programmed as possible, a shown, and such programming may be accomplished in known manner to provide a simple yet elegant packaging apparatus 100.

It will be understood that each station, including the accumulation station, as well as the control system for the apparatus 10, may incorporate generic structure different from those precisely disclosed herein, with only the novel combination and sequencing of elements being critical. Thus, a restriction should not be placed on the teaching herein by a strict conformation to the particular elements disclosed in the particular embodiment shown.

Further, although the downstream end of the packaging appartus 10 has been shown in the chosen embodiment to include a cartoner 32', it will be understood that this is not to be consideed limiting inasmuch as other structures, such as, for example, an overwrapper, a bag machine, or any other station used for completion of a finished package may be incorporated in place thereof. So long as the accumulator 60 or 70 is positioned between the packaging station 12 and the cutting station 28, any downstream processor may be accommodated by the apparatus 10.

As described above, the accumulator structure incorporated into the packaging apparatus 10 provides a number of advantages, some of which have been described above and others of which are inherent in the invention. Also, modifications can be proposed to the structure disclosed herein without departing from the teachings herein. Accordingly, the scope of the invention is only to be limited as necessitated by the accompanying claims.

I claim:

1. A method of making individual filled packages on a packaging apparatus including packaging stations for forming, filling, and sealing packages in a continuous chain, and a remote cutting station to separate individual packages from said chain, said method including extending said chain of forming, filling and sealing packages from said packaging stations to said cutting station, causing said packaging stations and said cutting stations to operate at a uniform rate of forming filling, sealing and cutting, permitting said packaging stations to operate during periods of cutting station shutdown accumulating said chain of formed, filled and sealed packages between said cutting station and said packaging stations during said periods of cutting station shutdown on resumption of operation of said cutting station, operating said packaging station and cutting station, so as to cut more packages than the number of packages formed, filled and sealed during a given time period, and, thereafter, operating said packaging stations and cutting station at a uniform rate.

2. A method of making individual filled packages on a packaging apparatus as claimed in claim 1 further including:

providing an accumulator between said packaging stations and said cutting station and receiving said chain of formed, filled, and sealed packages made during periods of cutting station shutdown on said accumulator at said uniform rate.

3. A method of making individual filled packages on a packaging apparatus as claimed in claim 2, said method further including:

recognizing accumulation of formed, filled and sealed packages during periods of cutting station shutdown and on resumption of operation of said packaging stations, operating said packaging stations and cutting station so as to cut more packages than are formed, filled, and sealed until said accumulation is accommodated.

4. A method of making individual filled packages on a packaging apparatus as claimed in claim 3, said method further including:

recognizing periods of cutting station shutdown and operating said packaging stations at a reduced rate of package forming, filling and sealing for at least a portion of said period of cutting station shutdown.

5. A packaging machine comprising:

a.) a packaging apparatus for forming, filling and sealing individual packages in a connected chain;

b.) a remote cutting station to separate packages from said chain;

c.) a control means associated with said packaging apparatus and cutting station to control the operation of said packaging apparatus and said cutting station;

said control means adapted to cause said packaging apparatus and cutting station to operate at a uniform rate of package forming, filling, sealing, and cutting;

said control means being adapted to cause operation of said packaging apparatus during periods of shutdown of said cutting station to accumulate formed, filled and sealed packages in a chain of packages extending from said packaging apparatus to said cutting station;

said control means further being adapted to resume operation of said cutting station and to operate said packaging apparatus and cutting station at relative rates to reduce said accumulation of formed, filled and sealed packages, said control means further being adapted to resume operation of said packaging apparatus and cutting station at uniform rates of package forming, filling, sealing and cutting.

6. A packaging machine as claimed in claim 5 wherein:

said machine further includes an accumulator disposed between said packaging apparatus and said cutting station to receive said chain of formed, filled, and sealed packages accumulated during periods of cutting station shutdown.

7. A packaging machine as claimed in claim 5 wherein:

said control means further includes means to recognize accumulation of packages;

said control means being responsive to said means to cause said packaging apparatus and said cutting station to operate at said relative rates to reduce said accumulation.

8. A packaging machine as claimed in claim 7 wherein:

a.) said control means further includes means to recognize accommodation of an accumulation of packages;

b.) said control means being responsive to said means to resume operation of said packaging apparatus and cutting station at uniform rates of package forming, filling, sealing and cutting.

9. A package machine as claimed in claim 8 wherein:

said control means include means to recognize shutdown of said cutting station;

said control means being responsive to shutdown of said cutting station to reduce the rate of packaging, forming, filling and sealing by said packaging apparatus during periods of cutting station shutdown.

10. A packaging machine as claimed in claim 8 wherein:

said machine further includes package processing apparatus downstream of said cutting station and said control means include means to recognize the status of operation of said downstream processing apparatus;

said control means being responsive to said status to control operation of said cutting station.

11. A packaging machine as claimed in claim 9 wherein:

said machine further includes package processing apparatus downstream of said cutting station and said control means include means to recognize the status of operation of said downstream processing apparatus;

said control means being responsive to said status to control operation of said cutting station.

12. A packaging machine as claimed in claim 6 wherein said accumulator is a conveyor including a powered belt to receive said accumulation.

13. A packaging machine as claimed in claim 12 wherein said control means controls the movement of said powered belt.

14. A packaging machine as claimed in claim 7 wherein said means to recognize said accumulation comprises sensing means to sense the accumulation of packages.

15. A packaging machine as claimed in claim 8 wherein:

said means to recognize said accumulation comprises sensing means to sense the accumulation of packages; and, wherein said means to recognize accommodation of an accumulation comprises said sensing means.

16. A packaging machine as claimed in claim 15 wherein:

said machine further includes an accumulator disposed between said packaging apparatus and said cutting station to receive said chain of formed, filled, and sealed packages accumulated during periods of cutting station shutdown.

17. A packaging machine comprising:

a.) a packaging apparatus for forming, filling and sealing individual packages in a connected chain;

b.) a remote cutting station to separate packages from said chain;

c.) a control means associated with said packaging apparatus and cutting station to control the operation of said packaging apparatus and said cutting station;

said control means adapted to cause said packaging apparatus and cutting station to operate at a uniform rate of package forming, filling, sealing, and cutting;

said control means being adapted to cause operation of said packaging apparatus during periods of shutdown of said cutting station to accumulate formed, filled and sealed packages in a chain of packages extending from said packaging apparatus to said cutting station;

said control means further being adapted to resume operation of said cutting station and to operate said packaging apparatus and cutting station to cause more packages to be cut than are formed, filled and sealed in a given time period, said control means further being adapted to resume operation of said packaging apparatus and cutting station at uniform rates of package forming, filling, sealing and cutting.

18. A packaging machine as claimed in claim 17 wherein:

said machine further includes an accumulator disposed between said packaging apparatus and said cutting station to receive said chain of formed, filled, and sealed packages accumulated during periods of cutting station shutdown.

19. A packaging machine as claimed in claim 18 wherein:

said control means further includes means to recognize accumulation of packages;

said control means being responsive to said means to cause said packaging apparatus and said cutting station to operate to cause more packages to be cut than are formed, filled and sealed in a given time period.

20. A packaging machine as claimed in claim 19 wherein:

a.) said control means further includes means to recognize accommodation of an accumulation of packages;

b.) said control means being responsive to said means to resume operation of said packaging apparatus and cutting station at uniform rates of package forming, filling, sealing and cutting.

21. A package machine as claimed in claim 20 wherein:

said control means include means to recognize shutdown of said cutting station;

said control means being responsive to shutdown of said cutting station to reduce the rate of packaging, forming, filling and sealing by said packaging apparatus during periods of cutting station shutdown.

22. A packaging machine as claimed in claim 20 wherein:

said machine further includes package processing apparatus downstream of said cutting station and said control means include means to recognize the status of operation of said downstream processing apparatus;

said control means being responsive to said status to control operation of said cutting station.

23. A packaging machine as claimed in claim 21 wherein:

said machine further includes package processing apparatus downstream of said cutting station and said control means include means to recognize the status of operation of said downstream processing apparatus;

said control means being responsive to said status to control operation of said cutting station.

24. A packaging machine as claimed in claim 18 wherein said accumulator is a conveyor including a powered belt to receive said accumulation.

25. A packaging machine as claimed in claim 24 wherein said control means controls the movement of said powered belt.

26. A packaging machine as claimed in claim 18 wherein said means to recognize said accumulation comprises sensing means to sense the accumulation of packages.

27. A packaging machine as claimed in claim 20 wherein:

said means to recognize said accumulation comprises sensing means to sense the accumulation of packages; and, wherein said means to recognize accommodation of an accumulation comprises said sensing means.

28. A packaging machine as claimed in claim 27 wherein:

said machine further includes an accumulator disposed between said packaging apparatus and said cutting station to receive said chain of formed, filled, and sealed packages accumulated during periods of cutting station shutdown.

29. In a circuitry controlled packaging apparatus of the type including packaging stations, a cutting station for separating packages produced in chain fashion in said packaging stations, and a downstream processing apparatus, the improvement comprising:

an accumulator structure functionally engaged between an outlet from said packaging stations and an inlet to said cutting station for accumulating thereon any overflow of chained packages created in said packaging stations, within predefined limits, until said overflow of chained packages is accommodated by said cutting station, such as during times of shutdown of said downstream processing apparatus; and means to shut down said cutting station upon shut down of said downstream processing apparatus.

* * * * *

UNITED STATES PATENT AND TRADEMARK OFFICE

CERTIFICATE OF CORRECTION

PATENT NO. : 5,617,706

DATED : April 8, 1997

INVENTOR(S) : Donn A. Hartman, et. al.

It is certified that error appears in the above-indentified patent and that said Letters Patent is hereby corrected as shown below:

Claim 1, line 19, cancel "a" and substitute ---said---.

Signed and Sealed this

Twenty-ninth Day of July, 1997

Bruce Lehman

*Attest:*

BRUCE LEHMAN

*Attesting Officer*

*Commissioner of Patents and Trademarks*

US005617706B1

REEXAMINATION CERTIFICATE (3644th)

United States Patent [19] [11] B1 5,617,706

Hartman et al. [45] Certificate Issued Oct. 6, 1998

[54] ACCUMULATOR AND COLLATOR FOR PACKAGING APPARATUS

[75] Inventors: Donn A. Hartman, Gurnee; William N. Pearson, Highland Park, both of Ill.

[73] Assignee: Cloud Corporation, Des Plaines, Ill.

Reexamination Request:
No. 90/004,920, Feb. 18, 1998

Reexamination Certificate for:

| | |
|---|---|
| Patent No.: | **5,617,706** |
| Issued: | **Apr. 8, 1997** |
| Appl. No.: | **507,931** |
| Filed: | **Jul. 27, 1995** |

Certificate of Correction issued Jul. 29, 1997.

Related U.S. Application Data

[63] Continuation of Ser. No. 294,657, Aug. 23, 1994, abandoned, which is a continuation of Ser. No. 940,521, Sep. 4, 1992, Pat. No. 5,359,832.

[51] Int. Cl.[6] ..... B65B 9/08; B65B 61/10

[52] U.S. Cl. ..... 53/435; 53/64; 53/520; 53/562; 83/236

[58] Field of Search ..... 53/435, 455, 513, 53/520, 568, 567, 562, 64, 77, 52; 83/236, 336

[56] References Cited

U.S. PATENT DOCUMENTS

| | | | |
|---|---|---|---|
| 4,545,780 | 10/1985 | Martin | 83/236 X |
| 4,793,118 | 12/1988 | Meier | 53/118 |
| 4,841,714 | 6/1989 | Meier | 53/429 |

*Primary Examiner*—James F. Coan

[57] ABSTRACT

A packaging machine including packaging apparatus to form fill and seal a chain of connected packages, a cutting station to separate the packages, means to operate the forming, filling and sealing apparatus and cutting apparatus so as to cut more packages than are formed, filled and sealed during a given time period.

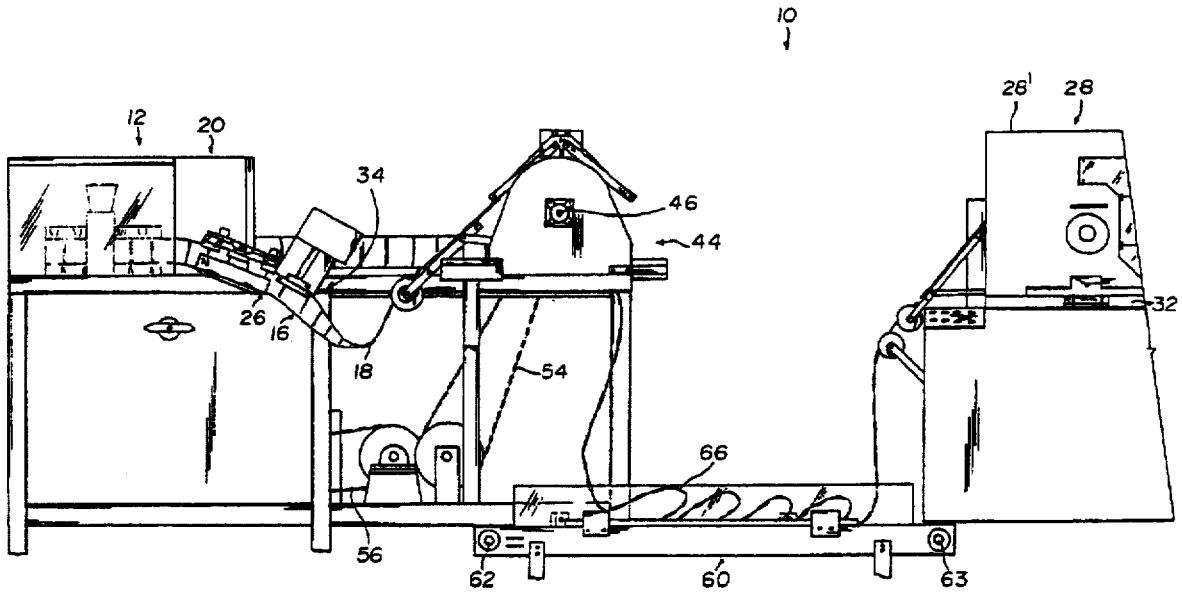

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–28 is confirmed.

Claim 29 is cancelled.

* * * * *